US010093504B2

(12) United States Patent
Hara

(10) Patent No.: US 10,093,504 B2
(45) Date of Patent: Oct. 9, 2018

(54) IMAGE FORMING APPARATUS

(71) Applicant: KONICA MINOLTA, INC., Chiyoda-ku, Tokyo (JP)

(72) Inventor: Takahiro Hara, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 350 days.

(21) Appl. No.: 15/010,883

(22) Filed: Jan. 29, 2016

(65) Prior Publication Data

US 2016/0272454 A1 Sep. 22, 2016

(30) Foreign Application Priority Data

Mar. 16, 2015 (JP) ..... 2015-052181

(51) Int. Cl.

| | |
|---|---|
| ***B65H 20/02*** | (2006.01) |
| ***B65H 23/038*** | (2006.01) |
| ***G03G 15/00*** | (2006.01) |
| ***G03G 21/00*** | (2006.01) |
| ***B65H 23/04*** | (2006.01) |

(52) U.S. Cl.

CPC ..... *B65H 20/02* (2013.01); *B65H 23/038* (2013.01); *B65H 23/048* (2013.01); *B65H 2801/03* (2013.01)

(58) Field of Classification Search

CPC ..... B65H 23/00; B65H 23/02; B65H 23/032; B65H 23/035; B65H 23/038; B65H 23/048; B65H 20/02; B65H 2801/03; G03G 15/00; G03G 21/00

See application file for complete search history.

(56) References Cited

U.S. PATENT DOCUMENTS 3,598,332 A * 8/1971 Sharkey ..... D21F 1/36 226/196.1
4,212,422 A * 7/1980 Rauchfuss, Jr. ..... B65H 23/038 226/180
6,104,907 A 8/2000 Obata et al.
(Continued)

FOREIGN PATENT DOCUMENTS

WO 03010080 A1 2/2003

OTHER PUBLICATIONS

Chinese Office Action (and English translation thereof) dated Apr. 1, 2017, issued in counterpart Chinese Application No. CN 201610146316.0.

*Primary Examiner* — Nguyen Ha
(74) *Attorney, Agent, or Firm* — Holtz, Holtz & Volek PC

(57) ABSTRACT

Provided is an image forming apparatus capable of obtaining a high deviation prevention capability while suppressing adhesion of paste to a side regulating member.

A plurality of roller members, for example, an upstream side roller member 91 and a downstream side roller member 92 are disposed along a sheet conveyance direction in which a recording sheet is conveyed. Then, first side regulating members 94A and 94B are provided at both end parts of the upstream side roller member 91 in a fixed state, and also second side regulating members 95A and 95B are provided at both end parts of the downstream side roller member 92 in a rotatable state. The first side regulating members 94A and 94B and the second side regulating members 95A and 95B regulate the deviation of a roll sheet S by the contact with the edge parts of the roll sheet S.

9 Claims, 8 Drawing Sheets

(56) References Cited

U.S. PATENT DOCUMENTS

| | | | |
|---|---|---|---|
| 6,357,349 | B1 | 3/2002 | Tomberlin et al. |
| 7,395,025 | B2 | 7/2008 | Matsuzuki et al. |
| 2002/0008113 | A1 | 1/2002 | Fujii et al. |
| 2008/0230975 | A1 | 9/2008 | Matsuzuki et al. |

* cited by examiner

IMAGE FORMING APPARATUS

BACKGROUND OF THE INVENTION

Field of the Invention

The present invention relates to an image forming apparatus, and, in particular, relates to an electro-photographic image forming apparatus.

Description of the Related Art

There is widely spread an electro-photographic image forming apparatus which transfers a toner image formed on a photoreceptor onto a recording medium such as a sheet, and fixes the toner image onto the recording medium by heating and pressurizing the recording medium onto which the toner image is transferred, in a high temperature fixing portion. The electro-photographic image forming apparatus is applied to a copier, a printer apparatus, a facsimile apparatus, a printing machine, a multi-functional machine, and the like.

In such a type of image forming apparatus, for the case where the recording medium is a sheet wound in a roll shape (in the following, described as "roll sheet"), when conveying the roll sheet to an image forming portion, it is necessary to convey the roll sheet so as not to deviate the roll sheet to one side in a direction perpendicular to a sheet conveyance direction. For preventing the deviation of the roll sheet, conventionally, the roll sheet is conveyed while the deviation is prevented, by causing an edge part of the roll sheet to which tension is applied, to contact a fixed side regulating member (refer to Patent Document 1, for example).

RELATED ART DOCUMENT

Patent Document

Patent Document 1: WO 2003/010080

SUMMARY OF THE INVENTION

Problems to be Solved by the Invention

According to the conventional technique described in Patent Document 1, however, since the edge part of the roll sheet is configured to slide with respect to the fixed side regulating member, when the roll sheet is a tack sheet to which paste is applied, sometimes paste attaches to the side regulating member caused by the sliding, and eventually mass of the paste enters a transfer portion to cause an image failure. Further, if the tension applied to the roll sheet is reduced for suppressing adhesion of paste to the side regulating member caused by the sliding, a sufficient deviation prevention capability is not obtained.

Accordingly, an object of the present invention is to provide an image forming apparatus capable of obtaining a high deviation prevention capability while suppressing adhesion of paste to the side regulating member.

Solution to Problem

To achieve the above object, an image forming apparatus reflecting one aspect of the present invention includes:

a plurality of roller members disposed along a sheet conveyance direction in which a recording sheet is conveyed;

first side regulating members provided near both end parts of a roller member on an upstream side in the sheet conveyance direction among the plurality of roller members, in a state fixed to edge parts of the conveyed recording sheet, respectively; and, second side regulating members provided near both end parts of a roller member on a downstream side in the sheet conveyance direction among the plurality of roller members, in a state rotatable with respect to edge parts of the conveyed recording sheet, respectively.

In the image forming apparatus having the above configuration, when the recording sheet is conveyed, the first side regulating member and the second side regulating member contact the edge part of the recording sheet to regulate the deviation of the recording sheet. The deviation prevention capability (regulating capability) of the first and second regulating members becomes higher as the tension applied to the recording sheet is increased. Here, by providing the plurality of roller members, it is possible to provide a difference between tension applied to the recording sheet at the roller member on the upstream side and tension applied to the recording sheet at the roller member on the downstream side. Then, when the tension on the upstream side is lower than that on the downstream side, the deviation prevention capability of the first side regulating member becomes lower than that of the second side regulating member. On the other hand, when the recording sheet is a tack sheet, the first side regulating member can suppress the adhesion of paste caused by the sliding with the edge of the recording sheet because of the reduced tension of the recording sheet. Meanwhile, the second side regulating member, because it is provided rotatably, does not cause the sliding with the edge of the recording sheet. Therefore, the second side regulating member can suppress the adhesion of paste almost completely, even when the tension of the recording sheet on the downstream side is higher than that of the recording sheet on the upstream side.

DESCRIPTION OF THE PREFERRED EMBODIMENTS

Hereinafter, there will be explained a mode for carrying out the present invention (in the following, described as "embodiment") in detail by the use of the drawings. The present invention is not limited to the embodiment, and various numerical values and the like in the embodiment are exemplary. Note that, in the following explanation and each of the drawings, the same sign is used for the same element and an element having the same function and duplicated explanation will be omitted.

<Image Forming System to which the Present Invention is Applied>

Figure 1:
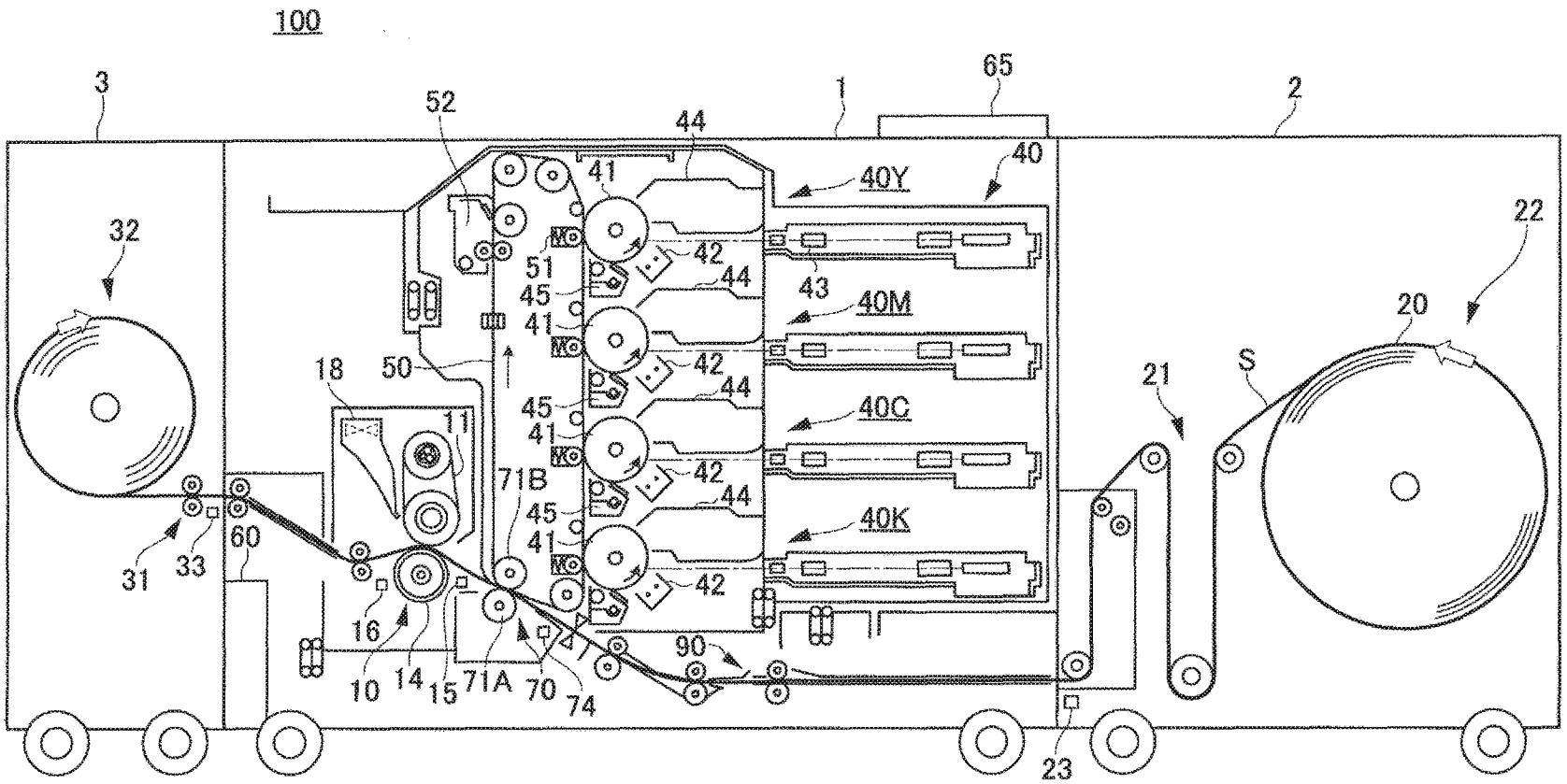
FIG. 1 is a schematic configuration diagram illustrating a configuration example of an image forming system to which the present invention is applied.

FIG. 1 is a schematic configuration diagram illustrating a configuration example of an image forming system to which the present invention is applied. As illustrated in FIG. 1, an image forming system 100 according to the present application example is an image forming system which uses a roll sheet S as a recording sheet (recording medium), and includes an image forming apparatus 1, a sheet feeding apparatus 2 to feed the roll sheet S to the image forming apparatus 1, and a sheet ejecting apparatus 3 to wind up the roll sheet S ejected from the image forming apparatus 1. The image forming apparatus 1 is an image forming apparatus according to an embodiment of the present invention. The roll sheet S is a recording sheet (long sheet) wound in a roll shape. In the following, the configurations of the image forming apparatus 1, the sheet feeding apparatus 2, and the sheet ejecting apparatus 3 will be explained individually.

[Image Forming Apparatus]

First, the image forming apparatus 1 will be explained. The image forming apparatus 1 employs an electro-photographic system which forms an image on the roll sheet S using static electricity, and is a color image forming apparatus of a tandem type which overlaps four color toners of yellow (Y), magenta (M), cyan (C), and black (Bk).

As illustrated in FIG. 1, the image forming apparatus 1 includes a sheet conveying apparatus 90, an image forming portion 40, an intermediate transfer belt 50, a secondary transfer portion 70, a fixing portion 10, an air blower 18, an upstream side sensor 15, a downstream side sensor 16, an operation display portion 65, and a control portion 60.

The sheet conveying apparatus 90 is configured with a plurality of conveyance rollers provided on the upstream side of the secondary transfer portion 70, and conveys the roll sheet S conveyed from the sheet feeding apparatus 2 continuously to the secondary transfer portion 70 provided at a transfer position. The sheet conveying apparatus 90 is a sheet conveying apparatus according to an embodiment of the present invention and the details thereof will be described below.

The image forming portion 40 has four image forming units 40Y, 40M, 40C, and 40K for forming a toner image of yellow (Y), a toner image of magenta (M), a toner image of cyan (C), and a toner image of black (Bk), respectively, on photoreceptors 41 which are image carriers.

A first image forming unit 40Y forms a yellow toner image, a second image forming unit 40M forms a magenta toner image. Further, a third image forming unit 40C forms a cyan toner image, and a fourth image forming unit 40K forms a black toner image. The four image forming units 40Y, 40M, 40C, and 40K have the same configuration. Accordingly, here the first image forming unit 40Y will be explained.

The first image forming unit 40Y has a photoreceptor 41 in a drum shape, and a charger 42, an exposure equipment 43, a developer 44, and a cleaner 45 disposed around the photoreceptor 41. The photoreceptor 41 rotates counter-clockwise under the drive of an un-illustrated drive motor. The charger 42 charges the surface of the photoreceptor 41 uniformly by applying charge to the photoreceptor 41. The exposure equipment 43 forms an electrostatic latent image on the photoreceptor 41 by performing exposure scanning on the surface of the photoreceptor 41 according to image data transmitted from the outside.

The developer 44 attaches yellow toner to the electrostatic latent image formed on the photoreceptor 41. Thereby, a yellow toner image is formed on the surface of the photoreceptor 41. Here, a developer 44 of the second image forming unit 40M attaches magenta tonner to a photoreceptor 41, and a developer 44 of the third image forming unit 40C attaches cyan toner to a photoreceptor 41. In addition, a developer 44 of the fourth image forming unit 40K attaches black toner to a photoreceptor 41.

The toner attached to the photoreceptor 41 is transferred to the intermediate transfer belt 50. The cleaner 45 removes the toner remaining on the surface of the photoreceptor 41 after the toner has been transferred to the intermediate transfer belt 50.

The intermediate transfer belt 50 is formed endlessly, and wound across a plurality of rollers. The intermediate transfer belt 50 is rotated clockwise in a direction opposite to the rotation direction of the photoreceptor 41, under the drive of an un-illustrated drive motor. For the intermediate transfer belt 50, primary transfer portions 51 are provided at positions facing the photoreceptors 41 of the image forming units 40Y, 40M, 40C, and 40K, respectively. The primary transfer portion 51 transfers the toner image formed on the photoreceptor 41 to the intermediate transfer belt 50 by applying a voltage having a polarity opposite to that of the tonner to the intermediate transfer belt 50.

Then, by the rotation of the intermediate transfer belt 50, the respective toner images formed by the four image forming units 40Y, 40M, 40C and 40K are transferred onto the surface of the intermediate transfer belt 50 sequentially. Thereby, a color image is formed on the intermediate transfer belt 50 by overlapping of the yellow toner image, magenta toner image, cyan toner image, and black toner image.

The secondary transfer portion 70 is disposed near the intermediate transfer belt 50 and also on the downstream side of the sheet conveying apparatus 90 in the sheet conveyance direction. The secondary transfer portion 70 is configured with a pair of transfer rollers 71A and 71B including an upper transfer roller 71B on which the intermediate transfer belt 50 is laid, and a lower transfer roller 71A pressed toward the upper transfer roller side with the intermediate transfer belt 50 therebetween.

The secondary transfer portion 70 presses the roll sheet S conveyed by the sheet conveying apparatus 90 by the lower transfer roller 71A to the side of the intermediate transfer belt 50. Then, the secondary transfer portion 70 transfers the color toner image formed on the intermediate transfer belt 50 onto the roll sheet S conveyed by the sheet conveying apparatus 90. A cleaner 52 removes the tonner remaining on the surface of the intermediate transfer belt 50 after the toner image has been transferred onto the roll sheet S.

Further, a pre-transfer sensor 74 is provided near the secondary transfer portion 70 and on the upstream side of the secondary transfer portion 70 in the sheet conveyance direction. The pre-transfer sensor 74 detects presence or absence of the sheet (roll sheet S) on the upstream side of the secondary transfer portion 70 in the sheet conveyance direction.

The fixing portion 10 is provided on the ejection side of the roll sheet S in the secondary transfer portion 70. The fixing portion 10 includes a fixing belt 11 and a fixing roller 12, and pressurizes and heats the roll sheet S to fix the toner image transferred onto the roll sheet S to the roll sheet S.

Figure 2:
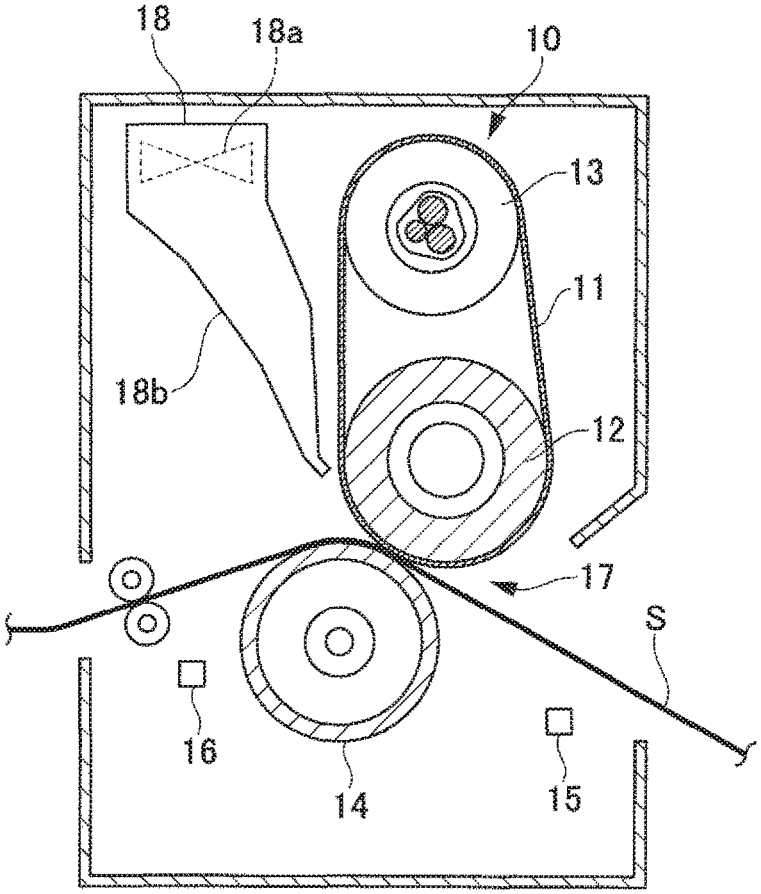
FIG. 2 is a schematic configuration diagram illustrating a configuration example of a fixing portion in an image forming apparatus according to an embodiment of the present invention.

FIG. 2 illustrates a configuration example of the fixing portion 10 in the image forming apparatus 1. As illustrated in FIG. 2, the fixing belt 11 is configured with an endless elastic member, and stretched across the fixing roller 12 which is a driving roller and a heating roller 13 which is a driven roller. The fixing belt 11 is configured with an elastic member, in which PFA (tetrafluoroethylene) is coated on the surface layer of a base body made of PI (polyimide), for example.

The fixing roller 12 is configured with a cylindrical member having an outer diameter of 50 to 90 mm, and has an elastic layer having a thickness of approximately 10 to 30 mm, for example, on a core metal. The heating roller 13 is configured with a cylindrical member having an outer diameter of 50 to 90 mm and including a halogen heater (in the following, sometimes described as "fixing heater") therein, and the surface thereof is coated with PFTE (polytetrafluoroethylene).

The heating roller 13 is heated by the halogen heater, and thereby the fixing belt 11 is heated. At this time, the temperature of the fixing belt 11 is controlled in a range of approximately 160 degrees to 210 degrees. Then, the heated fixing belt 11 travels while rotating clockwise by the rotational drive of the fixing roller 12.

A pressure roller 14 is configured with a cylindrical member having an outer diameter of 50 to 90 mm, and has an elastic layer having a thickness of approximately 10 to 20 mm, for example, on a core metal. The pressure roller 14 is provided so as to pressure-contact the fixing roller 12 with the fixing belt 11 therebetween by an un-illustrated pressuring mechanism. The pressure roller 14 rotates interlocking with the rotationally traveling fixing belt 11. In the present embodiment, the surface linear speed of the pressure roller 14 is 220 to 500 mm/sec.

Note that, while the pressure roller 14 is configured to be driven by the fixing belt 11 in the present embodiment, the pressure roller 14 may be configured to be a driving roller. Further, the pressure roller 14 can be also configured to include a fixing heater.

A nip portion 17 of the fixing portion 10 is formed at a part where the fixing belt 11 and the pressure roller 14 contact each other. Then, when the roll sheet S carrying the toner image passes through the nip portion 17 of the fixing portion 10, the toner is melted and fixed to the roll sheet S by the heating with the fixing belt 11 and the pressure roller 14 controlled to have a predetermined temperature.

The air blower 18 includes an axial fan 18*a* to blow out air in a desired air flow and a nozzle portion 18*b* to guide the air blown from the axial fan 18*a* so that it is injected near the nip portion 17. The nozzle portion 18*b* has a tip part configured to have a thin and long shape along a direction perpendicular to the rotation direction of the fixing belt 11, and is provided such that the longitudinal direction of the tip part is approximately parallel to the nip portion 17. Thereby, it is possible to inject the air uniformly to the roll sheet S having passed through the nip portion 17. It is possible to adjust the air flow of the air injected from the tip part of the nozzle portion 18*b* by controlling the value of current for driving the axial fan 18*a* to change the number of rotations of the axial fan 18*a*.

The upstream side sensor 15 is provided near the nip portion 17 formed by the fixing belt 11 and the pressure roller 14 and on the upstream side of the nip portion 17 in the sheet conveyance direction. The upstream side sensor 15 detects presence or absence of the sheet (roll sheet S) at a position facing the upstream side sensor 15. Further, the upstream side sensor 15 also functions as a tension detecting portion to detect the tension of the roll sheet S. Since the upstream side sensor 15 functions also as the tension detecting portion, it is possible to save space compared with a configuration in which the tension detecting portion is provided separately.

The downstream side sensor 16 is provided near the nip portion 17 formed by the fixing belt 11 and the pressure roller 14 and on the downstream side of the nip portion 17 in the sheet conveyance direction. The downstream side sensor 16 detects presence or absence of the sheet (roll sheet S) at a position facing the downstream side sensor 16.

The fixing portion 10 is provided with a fixing temperature sensor 19 to detect the temperature of the fixing portion 10 (sometimes described as "fixing temperature"). The fixing temperature sensor 19 is disposed near the fixing roller 12, for example, and thereby detects the temperature of the fixing portion 10. The disposition position of the fixing temperature sensor 19 shown in FIG. 2 is an example, and the position is not limited to the disposition position shown in FIG. 2. That is, the fixing temperature sensor 19 may be provided at a position where the temperature of the fixing portion 10 can be detected.

In FIG. 1, the operation display portion 65 is a touch panel configured with a display such as a liquid crystal display device or an organic EL (electroluminescence) display device. The operation display portion 65 displays an instruction menu for a user, information related to obtained image data, and the like. Moreover, the operation display portion 65 includes a plurality of keys, and has a role of an input portion to receive various kinds of instructions and data input of a character, a number, and the like by user's key operation. As an example, the user can input the type of the roll sheet S set in the sheet feeding apparatus 2 in the operation display portion 65.

Figure 3:
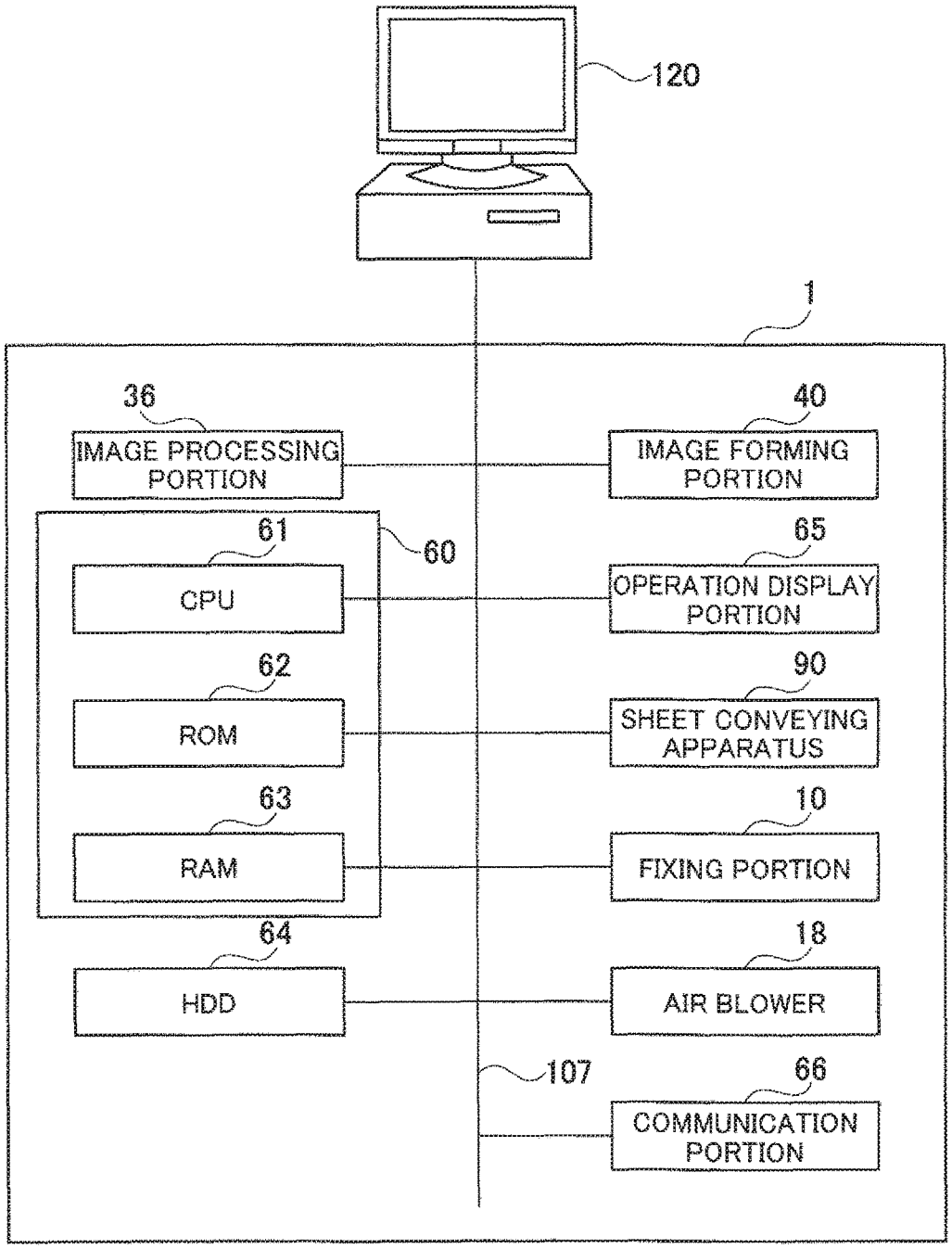
FIG. 3 is a block diagram illustrating a configuration example of a control system of an image forming apparatus according to an embodiment of the present invention.

The control portion 60 controls each portion of the image forming apparatus 1 according to an instruction from the operation display portion 65 or an external apparatus (e.g., personal computer 120 shown in FIG. 3). The detail of the control will be described below.

[Sheet Feeding Apparatus and Sheet Ejecting Apparatus]

Next, the sheet feeding apparatus 2 and the sheet ejecting apparatus 3 will be explained. As shown in FIG. 1, the sheet feeding apparatus 2 includes a conveyance portion 21, a roll sheet setting portion 22, and a sheet-feeding sensor 23. The roll sheet setting portion 22 rotatably sets a roll sheet main body 20 around which a desired roll sheet is wound. The conveyance portion 21 is configured with a plurality of conveyance rollers, and conveys the roll sheet S sent out from the roll sheet setting portion 22 to the side of the image forming apparatus 1. The sheet-feeding sensor 23 is provided near an ejecting port where the roll sheet S of the sheet feeding apparatus 2 is ejected to the side of the image forming apparatus 1, for example, and detects presence or absence of the sheet (roll sheet S) at a position facing the sheet-feeding sensor 23.

The sheet ejecting apparatus 3 includes a conveyance portion 31, a winding portion 32, and a sheet ejection sensor 33. The conveyance portion 31 is configured with a plurality of conveyance rollers, and conveys the roll sheet S ejected to the sheet ejecting apparatus 3 to the side of the winding portion 32. The winding portion 32 winds the roll sheet S conveyed by the conveyance portion 31 into a roll shape. The sheet ejection sensor 33 is provided near an input port of the roll sheet S conveyed from the side of the image forming apparatus 1, and detects presence or absence of the sheet (roll sheet S) at a position facing the sheet ejection sensor 33.

[Configuration of a Control System]

FIG. 3 is a block diagram illustrating a configuration example of a control system in the image forming apparatus according to an embodiment of the present invention. As illustrated in FIG. 3, the image forming apparatus 1 includes the control portion 60, an image processing portion 36, the image forming portion 40, the operation display portion 65, the sheet conveying apparatus 90, an HDD (Hard Disk Drive) 64, the fixing portion 10, the air blower 18, the fixing temperature sensor 19, and a communication portion 66.

The control portion 60 has a CPU (Central Processing Unit) 61, a ROM (Read Only Memory) 62 to store a program or the like executed by the CPU 61, and a RAM (Random Access Memory) 63 used as a work area of the CPU 61, for example. Here, usually an electrically-erasable programmable ROM is used as the ROM 62.

The control portion 60 is connected to each of the image processing portion 36, the image forming portion 40, the operation display portion 65, the sheet conveying apparatus 90, the HDD 64, the fixing portion 10, the air blower 18, and the communication portion 66, via a system bus 107, and controls the entire image forming apparatus 1. The control portion 60 further controls each of the portions in the sheet feeding apparatus 2 and the sheet ejecting apparatus 3 via the communication portion 66.

The image forming apparatus 1 is connected with a PC (Personal Computer) 120, for example, as an external apparatus. Then, image data is transmitted from the PC 120 to the image forming apparatus 1. The image data transmitted from the PC 120 is sent to the image processing portion 36 and image-processed in the image processing portion 36.

The image processing portion 36 performs the image processing such as various kinds of correction processing of shading correction, image density correction, color resist correction and the like, and image compression processing as needed on the received image data under the control of the control portion 60. The image forming portion 40 receives the image data image-processed by the image processing portion 36 under the control of the control portion 60, and forms an image on the roll sheet S according to the image data.

The user can perform the operation of inputting the type of the roll sheet S (type of sheet) and the like in the operation display portion 65. The communication portion 66 is a communication interface for connection to a network to which each of the apparatuses configuring the image forming system 100 is connected. For example, the image forming apparatus 1 performs serial communication with the sheet feeding apparatus 2 and the sheet ejecting apparatus 3 via the communication portion 66.

[Deviation of the Roll Sheet]

The above explained image forming system 100 has a system configuration in which the image forming apparatus 1 to form an image on the roll sheet S and the sheet feeding apparatus 2 to feed the roll sheet S to the image forming apparatus 1 are disposed integrally. On the other side, depending on the image forming system 100, sometimes the image forming apparatus 1 and the sheet feeding apparatus 2 are disposed independently apart from each other. In the case of the system configuration in which the image forming apparatus 1 and the sheet feeding apparatus 2 are disposed independently in this manner, the case where both of the apparatuses are disposed integrally but are so apart from each other as to make it difficult to secure a certain positional accuracy, or the like, sometimes there is caused a problem of the deviation of the roll sheet S that the roll sheet S travels deviated to one side in a direction perpendicular to the sheet conveyance direction.

The deviation problem of the roll sheet S will be described further in detail. Since it is difficult to secure a sufficient parallelism (in the following, described as "alignment") of rollers between the sheet feeding apparatus 2 and the image forming apparatus 1 and an sufficient positional accuracy in the front-back direction, the problem of the deviation or meandering of the roll sheet S is caused because of an insufficient accuracy. As a result, sometimes there is the case where the image is printed deviated with respect to the roll sheet S, and quality required by the market is not satisfied.

Since the conventional technique described in Patent Document 1 is configured to prevent the deviation by causing the edge part of the roll sheet to which tension is applied to contact a fixed side regulating member, in the case of a tack sheet to which paste is applied, sometimes paste attaches to the side regulating member caused by the sliding, and eventually mass of the paste enters a transfer portion to cause an image failure. Further, if the tension applied to the roll sheet is reduced for suppressing adhesion of paste to the side regulating member caused by the sliding, a sufficient deviation prevention capability (regulating capability) is not obtained.

<Image Forming Apparatus According to an Embodiment of the Present Invention>

The image forming apparatus 1 according to an embodiment of the present invention is achieved for the purpose of obtaining a high deviation prevention capability while preventing adhesion of paste to the side regulating member even when the conveyed roll sheet is a tack sheet, for example, in the sheet conveying apparatus 90 (refer to FIG. 1). Accordingly, the image forming apparatus 1 according to the present embodiment is preferably used as the image forming apparatus 1 in the image forming system 100 shown in FIG. 1 which uses the roll sheet S as a recording sheet.

Figure 4:
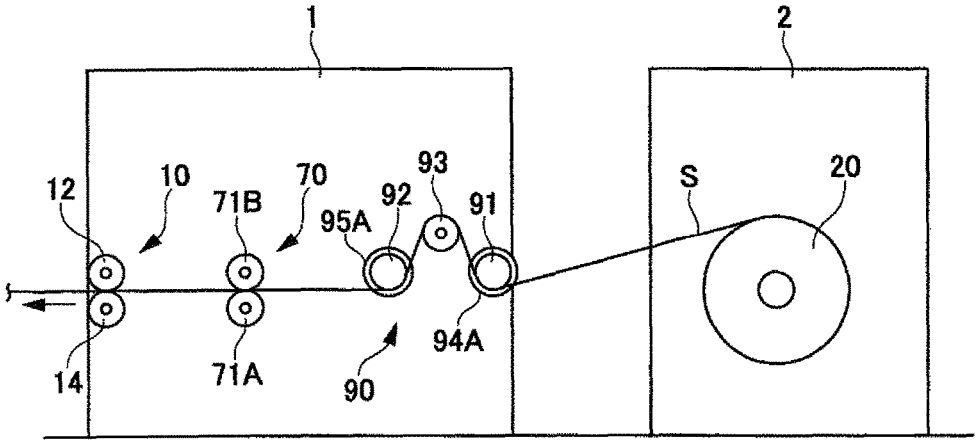
FIG. 4 is a schematic view illustrating a sheet conveyance path in a system configuration of disposing an image forming apparatus and a sheet feeding apparatus independently apart from each other.
Figure 5:
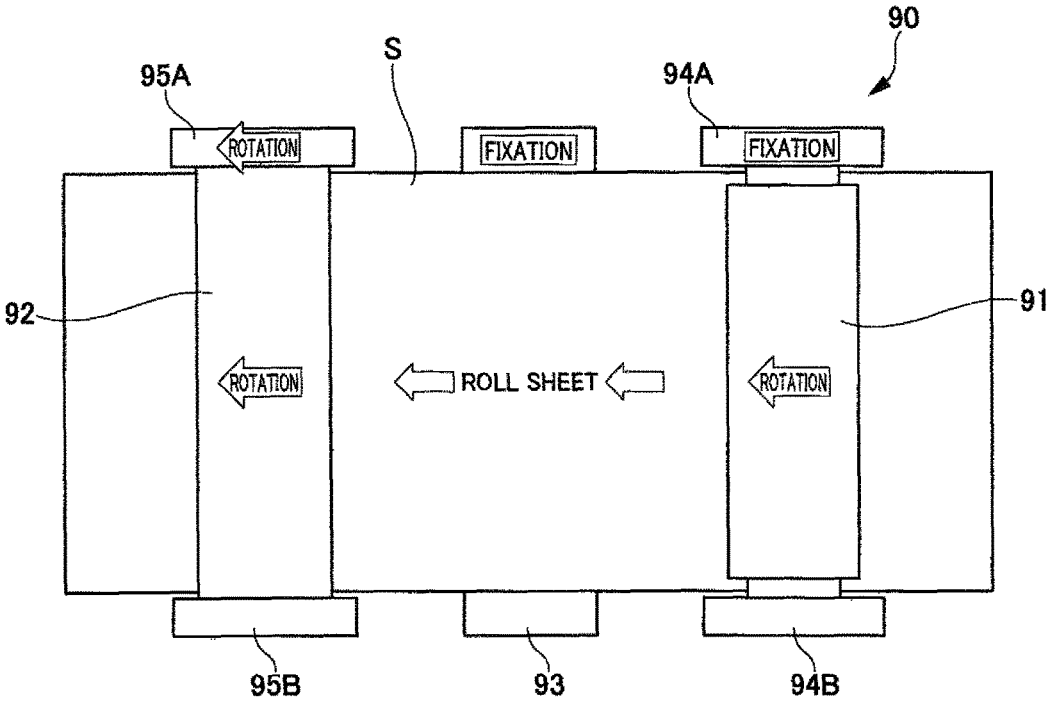
FIG. 5 is a plan view illustrating an outline configuration of a sheet conveying apparatus.

FIG. 4 is a schematic view illustrating a sheet conveyance path in a system configuration in which the image forming apparatus 1 and the sheet feeding apparatus 2 are disposed independently apart from each other. Here, for simplification of the drawing, as for the image forming apparatus 1, only a configuration of a conveyance path for the roll sheet S is shown including the sheet conveying apparatus 90, and the sheet feeding apparatus 2 is shown except the conveyance portion 21 and the sheet-feeding sensor 23 (refer to FIG. 1). Further, FIG. 5 is a plan view illustrating an outline configuration of the sheet conveying apparatus 90.

While FIG. 4 shows the system configuration in which the image forming apparatus 1 and the sheet feeding apparatus 2 are disposed independently apart from each other, as shown in FIG. 1, the system configuration may be a configuration in which the image forming apparatus 1 and the sheet feeding apparatus 2 are disposed integrally. As shown in FIG. 4, the sheet conveying apparatus 90 is provided on the downstream side of a sheet introduction portion, that is, the image forming portion 40 in the image forming apparatus 1. Here, the sheet introduction portion of the image forming apparatus 1 is a part where the roll sheet S fed from the sheet feeding apparatus 2 is introduced (taken in).

The sheet conveying apparatus 90 conveys the roll sheet S introduced into the image forming apparatus 1 toward the secondary transfer portion 70 (refer to FIG. 1). Thereby, in the sheet conveyance direction, the side of the sheet introduction portion in the sheet conveying apparatus 90 becomes the upstream side, and the side of the secondary transfer portion 70 becomes the downstream side. A predetermined break torque is applied to the roll sheet S set in the sheet feeding apparatus 2, a tension of 3N, for example, is caused in the roll sheet positioned between the image forming apparatus 1 and the sheet feeding apparatus 2 during the conveyance (during sheet feeding) of the roll sheet S from the sheet feeding apparatus 2 to the image forming apparatus 1.

The roll sheet S is pulled by the fixing roller 12 of the fixing portion 10 positioned on the downstream side of the secondary transfer portion 70, and thereby conveyed along the sheet conveyance path including the sheet conveying apparatus 90. The fixing roller 12 is driven by a motor M (refer to FIG. 8). The pair of transfer rollers 71A and 71B of the secondary transfer portion 70 are driven in a circumferential speed lower than that of the fixing roller 12 of the fixing portion 10 positioned on the downstream side thereof.

The sheet conveying apparatus 90 is configured including a plurality of cylindrical roller members disposed along the sheet conveyance direction, for example, two roller members of an upstream side roller member 91 and a downstream side roller member 92. While the configuration of disposing the two roller members 91 and 92 is illustrated here, the present embodiment is not limited to this case, and it is possible to employ a configuration of disposing a plurality of downstream side roller members 92, for example.

A fixed roller member 93 provided in a not rotatable state is disposed between the upstream side roller member 91 and the downstream side roller member 92. The fixed roller member 93 is an example of a tension applying member to apply tension to the roll sheet S, and is disposed positionally at a higher position than the roller members 91 and 92. Then, in the sheet conveying apparatus 90 including the roller members 91 to 93, the roll sheet S passes on the lower face side of the upstream side roller member 91, next passes on the upper face side of the fixed roller member 93, and lastly passes on the lower face side of the downstream side roller member 92. Thereby, the print face (image formation face) of the roll sheet S slides with respect to the upstream side roller member 91, and then the non-print face (image non-formation face) slides with respect to the fixed roller member 93, and lastly the print face slides with respect to the downstream side roller member 92.

The fixed roller member 93 applies tension to the roll sheet S by friction force caused in the sliding with the non-print face of the roll sheet S. While the fixed roller member 93 is illustrated here as an example of a tension applying member, the present embodiment is not limited to this case, and any other configurations may be employed if the tension can be applied to the roll sheet S by the friction force caused by the sliding with the non-print face of the roll sheet S.

As shown in FIG. 5, both of the upstream side roller member 91 and the downstream side roller member 92 are driven rollers to rotate interlocking with the traveling of the roll sheet S. The fixed roller member 93 is a fixed roller not to rotate interlocking with the traveling of the roll sheet S. The upstream side roller member 91 includes side regulating members (first side regulating members) 94A and 94B on both end parts thereof. The side regulating members 94A and 94B are provided in a fixed state with respect to the upstream side roller member 91. The downstream side roller member 92 includes side regulating members (second side regulating members) 95A and 95B on both end parts thereof. The side regulating members 95A and 95B are provided in a rotatable state with respect to the downstream side roller member 92.

The side regulating members 94A and 94B of the upstream side roller member 91 have a function of correcting comparatively rough alignment (roller parallelism) between the sheet feeding apparatus 2 and the image forming apparatus 1 and a positional shift of the roll sheet S in a direction perpendicular to the sheet conveyance direction. The side regulating members 95A and 95B of the downstream side roller member 92 have a function of accurately positioning the position of the roll sheet S in the direction perpendicular to the sheet conveyance direction in the secondary transfer portion 70 positioned on the downstream side.

[Fixation and Rotation of the Side Regulating Member]

Here, there will be explained a reason why the side regulating members 94A and 94B of the first side regulating members are fixed, and the side regulating members 95A and 95B of the second side regulating members are rotated.

In the case of the fixed side regulating member, the paste easily adheres to the side regulating member by the sliding with the edge part of the roll sheet S when the roll sheet S is a tack sheet, and therefore the side regulating member is preferably rotatable. However, in the case where the alignment error is comparatively large between the sheet feeding apparatus 2 and the image forming apparatus 1, for example, in the case where the alignment error is approximately 2 mm per 400 mm in the sheet conveyance direction, the side regulating members 94A and 94B on the upstream side cannot allow the accuracy shift in the rotation, and the roll sheet S easily runs over the side regulating members 94A and 94B.

More specific explanation will be made for the phenomenon that the roll sheet S runs over the side regulating member when the side regulating member is rotatable. Generally, a tapered face is provided on the inner-side face of the side regulating member (face on the side where the roll sheet S contacts the side regulating member). Then, from the moment when the edge part of the roll sheet S contacts the inner face of the side regulating member, force is generated in the tangent direction of the rotation direction of the side regulating member, and the roll sheet S is lifted up to float by the force and then runs over the tapered face. In the case of the fixed side regulating member, force is not generated in the tangent direction, and therefore the roll sheet S does not run over the side regulating member.

From such a reason, for obtaining a high deviation prevention capability (regulating capability) while suppressing adhesion of paste, it is preferable to fix the side regulating members 94A and 94B on the upstream side. For the side regulating members 95A and 95B on the downstream side, since the deviation of the roll sheet S is eliminated almost completely by the side regulating members 94A and 94B on the upstream side and the edge part of the roll sheet S does not slide, the roll sheet S does not run over the side regulating members 95A and 95B.

Further, a sufficient tension needs to be generated in the roll sheet S for reliably exhibiting the deviation prevention capability (regulating capability) without floating or turning of the edge part of the roll sheet S when the edge part of the roll sheet S contacts the side regulating member 94A or 94B. In this case, the deviation prevention capability becomes higher as the tension generated in the roll sheet S is increased. On the other hand, since the contact force of the edge part of the roll sheet S with the side regulating member 94A or 94B becomes larger as the tension generated in the roll sheet S is increased, it is disadvantageous from the viewpoint of the paste adhesion.

For the side regulating members 95A and 95B on the downstream side, since the deviation of the roll sheet S is eliminated almost completely by the side regulating members 94A and 94B on the upstream side, the deviation amount of the roll sheet S is small. Moreover, since basically the sliding with the edge part of the roll sheet S is not caused because the side regulating members 95A and 95B are rotatable, the paste scarcely adheres to the side regulating members 95A and 95B even when the tension generated in the roll sheet S is high.

From the above, a function required for each of the side regulating members 94A and 94B on the upstream side and the side regulating members 95A and 95B on the downstream side and a configuration of achieving the function are summarized as shown in Table 1.

TABLE 1

| | Side regulating member on the upstream side | Side regulating member on the downstream side |
|---|---|---|
| Required function | Accuracy shift allowance<br>Paste adhesion suppression | Accurate positioning<br>Paste adhesion suppression |
| Configuration | Fixed<br>Low tension | Rotatable<br>High tension |

As shown in Table 1, the function required for each of the side regulating members 94A and 94B on the upstream side is a function of correcting the comparatively rough alignment error between the sheet feeding apparatus 2 and the image forming apparatus 1 and the positional shift of the roll sheet S in the direction perpendicular to the sheet conveyance direction, that is, a function of allowing the accuracy shift. In addition, the side regulating members 94A and 94B on the upstream side are required to have a function of suppressing the paste adhesion. The side regulating members 95A and 95B on the downstream side are required to have a function of accurately positioning the position of the roll sheet S in the direction perpendicular to the sheet conveyance direction at the transfer portion 70 located on the downstream side and a function of suppressing the paste adhesion.

Further, for the configuration, the side regulating members 94A and 94B on the upstream side are fixed and the side regulating members 95A and 95B on the downstream side are rotatable. Preferably, the tension in the roll sheet S at the side regulating members 94A and 94B on the upstream side is set to be lower than the tension in the roll sheet S at the side regulating members 95A and 95B on the downstream side.

Further, Table 2 shows relative merits of the configurations of the side regulating members, that is, the fixed and rotatable of the side regulating members, and Table 3 shows relative merits of the high and low tensions in the roll sheet S.

TABLE 2

| | Paste adhesion suppression | Accuracy shift allowance |
|---|---|---|
| Side regulating member is rotatable | Good | No good |
| Side regulating member is fixed | No good | Good |

As shown in Table 2, the case where the side regulating member is rotatable is superior in the suppression effect of the adhesion of paste to the side regulating member (Good), but inferior in the accuracy shift allowance (No good). The case where the side regulating member is fixed is inferior in the suppression effect of the adhesion of paste to the side regulating member (No good), but superior in the accuracy shift allowance (Good).

TABLE 3

| | Paste adhesion suppression | Accurate positioning |
|---|---|---|
| Low tension | Good | No good |
| High tension | No good | Good |

As shown in Table 3, the case where the tension in the roll sheet S is low at the side regulating member is superior in the suppression effect of the adhesion of paste to the side regulating member (Good), but inferior in the accurate positioning (No good). The case where the tension in the roll sheet S is high at the side regulating member is inferior in the suppression effect of the adhesion of paste to the side regulating member (No good), but superior in the accurate positioning (Good).

From the above description, for achieving both of the suppression capability of the adhesion of paste to the side regulating member and the deviation prevention capability (regulating capability) of the roll sheet S, it is preferable to employ the following configuration. That is, preferably, the side regulating members 94A and 94B on the upstream side are fixed and the tension in the roll sheet S at the upstream side roller member 91 is low, and the side regulating members 95A and 95B on the downstream side are rotatable and the tension in the roll sheet S at the downstream side roller member 92 is high.

Tension is generated by the break torque of the sheet feeding apparatus 2 in the roll sheet S on the upstream side of the fixed roller member 93 located between the upstream side roller member 91 and the downstream side roller member 92, that is, at the upstream side roller member 91, in the sheet conveying apparatus 90 shown in FIG. 4 and FIG. 5. The tension generated by the break torque of the sheet feeding apparatus 2, that is, the tension generated in the roll sheet S at the upstream side roller member 91 is defined as T1.

Further, the fixed roller member 93 located at a position between the upstream side roller member 91 and the downstream side roller member 92 generates tension on the downstream side of the roller member 93 by the friction force caused in the sliding with the non-print face of the roll sheet S. The tension generated in the roll sheet S by the friction force with the fixed roller member 93 is defined as T2. The tension T2 is added to the tension T1 by the break torque of the sheet feeding apparatus 2 to generate tension T3 (=T1+T2) in the roll sheet S on the downstream side of the fixed roller member 93, that is, at the downstream side roller member 92.

The following relationship holds between the tension T3 in the roll sheet S at the downstream side roller member 92 and the tension T1 in the roll sheet S at the upstream side roller member 91.

$$T3>T1$$

Thereby, it is possible to achieve both of a high suppression capability of the adhesion of paste to the side regulating members 94A, 94B, 95A and 95B and a high deviation prevention capability (regulating capability) of the roll sheet S.

[Tension Adjustment of the Roll Sheet on the Downstream Side]

Figure 6:
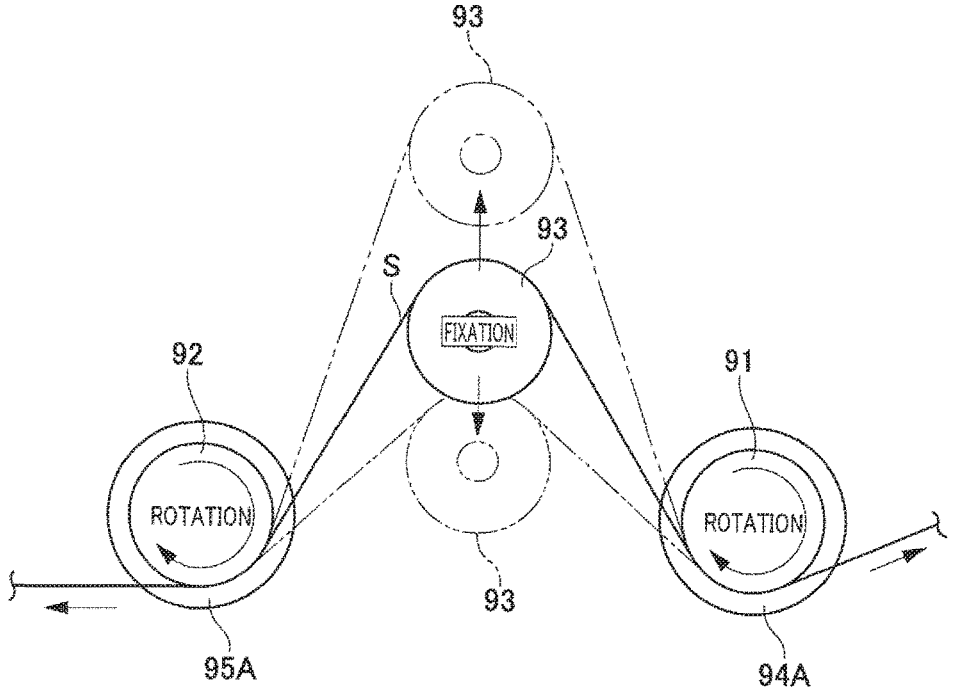
FIG. 6 is an explanatory diagram for tension adjustment of a roll sheet on the downstream side.

It is possible to adjust the tension T3 applied to the roll sheet S at the downstream side roller member 92 (described as "roll sheet S on the downstream side" in the following) by changing the height position of the fixed roller member 93 as shown in FIG. 6. Only the tension T3 in the roll sheet S on the downstream side is changed by the height adjustment of the fixed roller member 93, and the tension T1 in the roll sheet S on the upstream side is not changed. The reason is that break force is generated on the downstream side with the fixed roller member 93 as a fulcrum but the break force is not generated on the upstream side.

When the fixed roller member 93 is moved to the height position shown in FIG. 6 by the chain line, the winding amount of the roll sheet S around the roller member 93 is increased and thereby the friction force caused between the roller member 93 and the roll sheet S becomes large. As a result, since the tension T2 by the friction force becomes high, the tension T3 (=T1+T2) also becomes high in the roll sheet S on the downstream side. On the other hand, when the fixed roller member 93 is moved to the height position shown in FIG. 6 by the broken line, the winding amount of the roll sheet S around the roller member 93 is reduced, and thereby the friction force caused between the roller member 93 and the roll sheet S becomes small. As a result, since the tension T2 by the friction force becomes low, the tension T3 also becomes low in the roll sheet S on the downstream side.

It is possible to adjust the tension in the roll sheet S on the downstream side in a plurality of steps by adjusting the height position of the fixed roller member 93 in a stepwise manner according to the type of a medium (roll sheet S). For example, since a thin medium has a low stiffness and tends to make the tension low compared with a thick medium, the tension in the roll sheet S on the downstream side can be adjusted according to the thickness of the medium. Table 4 shows the case where the tension T3 in the roll sheet S on the downstream side can be adjusted roughly in three steps of "large", "medium", and "small" depending on the thickness of the medium. The tension T3 in the roll sheet S on the downstream side is adjusted by the tension T2 generated in the roll sheet S by the friction force with the fixed roller member 93. The steps of "large", "medium", and "small" of the tension T2 in Table 4 correspond to the height positions of the fixed roller member 93 shown in FIG. 6.

TABLE 4

| Medium thickness (mm) | Tension T2 |
|---|---|
| 0.05 to 0.10 | Large |
| 0.11 to 0.20 | Medium |
| 0.21 to 0.25 | Small |

As shown in Table 4, the tension T2 by the friction force with the fixed roller member 93 is set to "large" for the case where the medium thickness is 0.05 to 0.10 mm, set to "medium" in the case of 0.11 to 0.20 mm, and set to "small" in the case of 0.21 to 0.25 mm. While the adjustment can be performed roughly in the three steps of "large", "medium", and "small", here, the present embodiment is not limited to the case. For example, the adjustment can be performed also in a plurality of steps for "large" or in a plurality of steps for "small", for example, according to various conditions, specifically, according to the deviation speed of the roll sheet S to be described below, a width shrinkage amount of the roll sheet S, a load of the motor (motor M in FIG. 8) to convey the roll sheet S.

[Tension Adjusting Mechanism]

Figure 7:
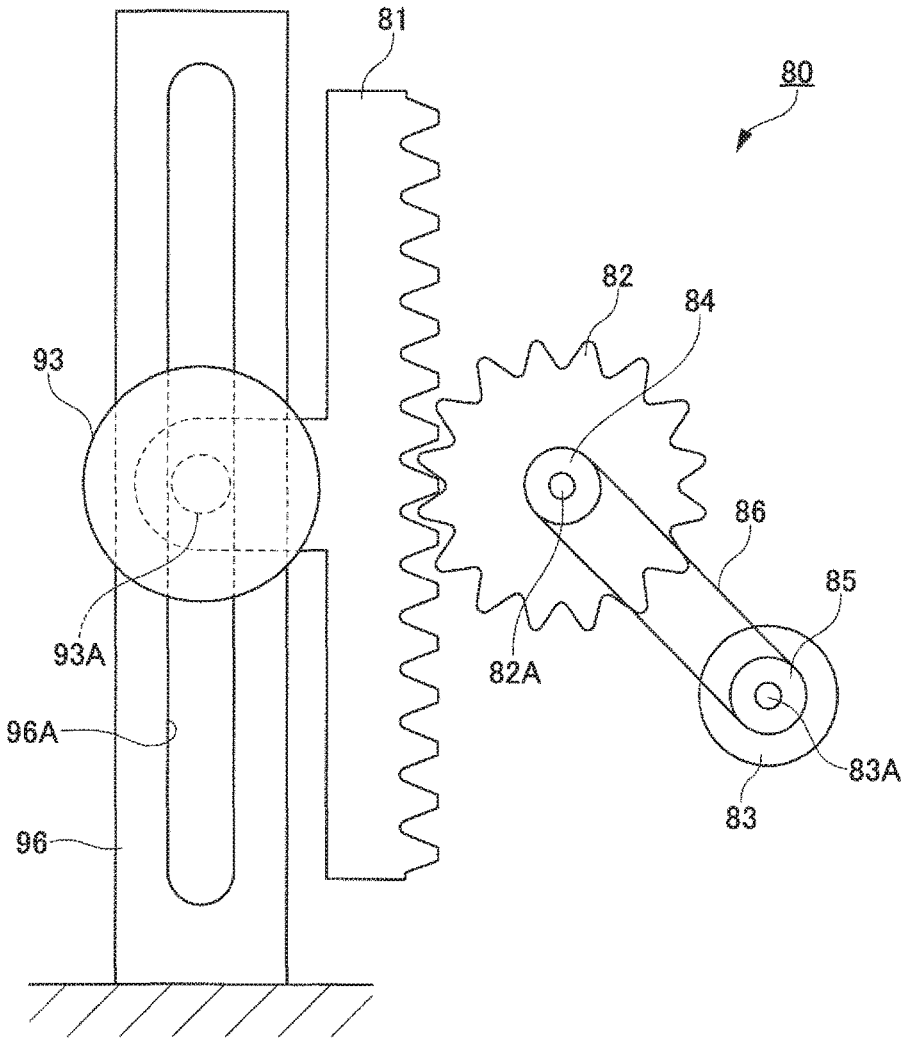
FIG. 7 is a schematic view illustrating one example of a configuration of a tension adjusting mechanism.

Here, there will be explained a tension adjusting mechanism to adjust the tension T3 in the roll sheet S on the downstream side by adjusting the tension T2 by the friction force with the fixed roller member 93 (sometimes simply described as "tension T2" in the following), by the use of FIG. 7. FIG. 7 is a schematic view illustrating a configuration example of the tension adjusting mechanism.

As shown in FIG. 7, the center axis 93A of the fixed roller member 93 fits in a slot 96A extending in the up-and-down direction of a support member 96, and thereby the fixed roller member 93 is supported by the support member 96 movably in the up-and-down direction (height direction). Then, the tension adjusting mechanism 80 drives the fixed roller member 93 in the up-and-down direction and thereby adjusts the tension in the roll sheet S on the downstream side. The tension adjusting mechanism 80 has a configuration including a combination of a rack 81 and a pinion 82 with a drive motor 83 as a drive source.

Specifically, the rack 81 is attached to the center axis 93A of the fixed roller member 93. Then, the pinion 82 bites the rack 81, and the rack 81 and the fixed roller member 93 move up and down when the pinion 82 rotates. A pulley 84 is attached to the rotation axis 82A of the pinion 82, and a pulley 85 is attached to the rotation axis 83A of the drive motor 83. Then, the pinion 82 is driven to rotate by the drive motor 83 via a belt 86 stretched between the pulley 84 and the pulley 85.

A stepping motor can be used as the drive motor 83, for example. The stepping motor is a device to convert an electric pulse signal into a mechanical intermittent step action, and the rotation angle thereof is determined by the number of pulses of the input pulse signal. Accordingly, by using the drive motor 83 configured with the stepping motor as the drive source of the tension adjusting mechanism 80, it is possible to easily and reliably adjust the height position of the fixed roller member 93 and eventually the tension applied to the roll sheet S on the downstream side according to the rotation angle of the stepping motor. The drive motor 83 is driven to rotate in a rotation angle corresponding to the tension T3 to be applied to the roll sheet S on the downstream side under the control of the control portion 60 (refer to FIG. 3).

Note that the configuration of the tension adjusting mechanism 80 illustrated here is an example, the present embodiment is not limited to the configuration. For example, it is also possible to use a configuration of attaching the pinion 82 directly to the rotation axis 83A of the drive motor 83. Further, except for the combination of the rack 81, the pinion 82, and the drive motor 83, it is possible to employ the following configuration. For example, the tension adjustment mechanism can be configured including a combination of a cam having a plurality of cam faces at different positions from the rotation axis in the radial direction (height position) and a motor to drive the cam, and to adjust the height position of the fixed roller member 93 using the plurality of cam faces.

[Specific Example of the Tension Adjustment in the Roll Sheet on the Downstream Side]

Figure 8:
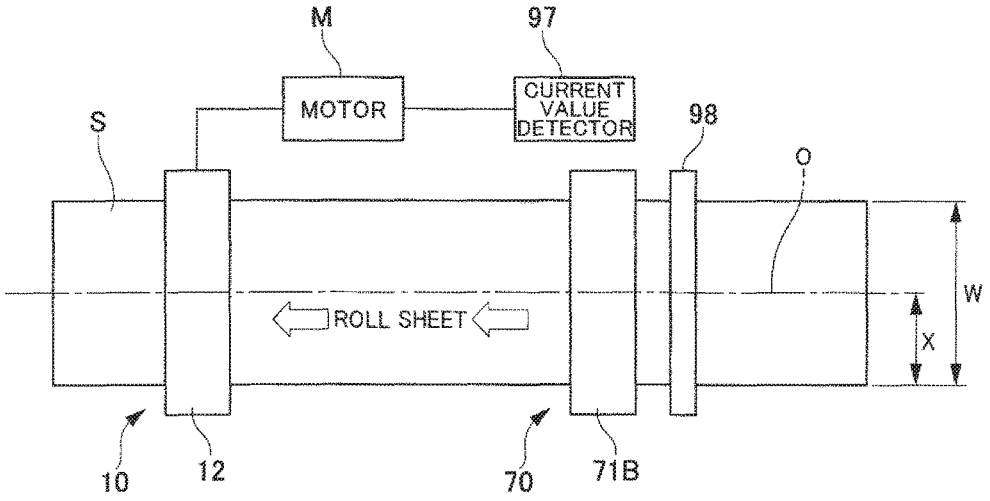
FIG. 8 is a plan view illustrating an outline configuration of a sheet conveyance path and its periphery including a fixing portion and a secondary transfer portion.
Figure 9:
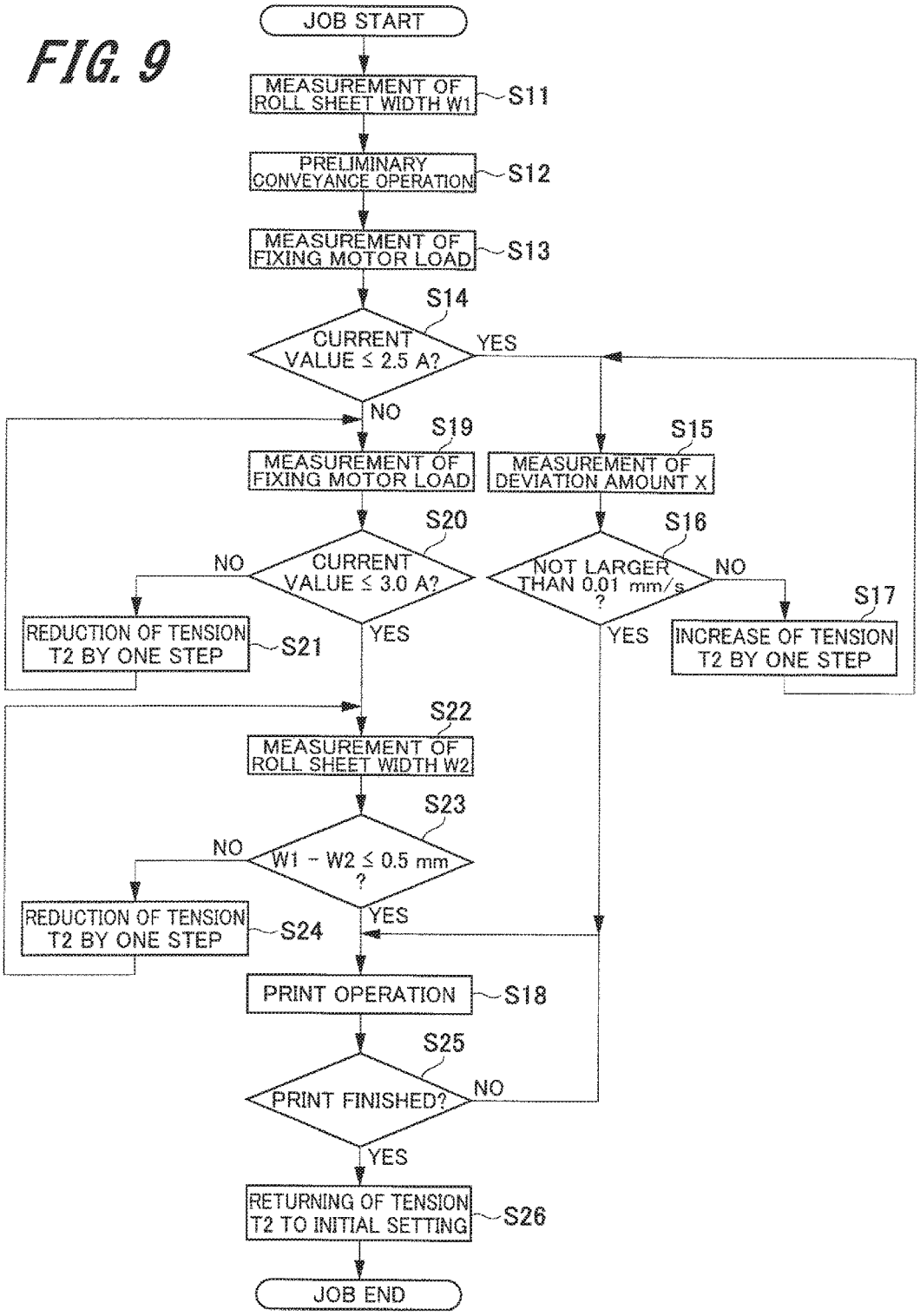
FIG. 9 is a flowchart illustrating an example of processing procedure for adjusting tension of a roll sheet S on the downstream side.

Next, there will be explained a specific example for adjusting tension of the roll sheet S on the downstream side by the use of FIG. 8 and FIG. 9. FIG. 8 is a plan view illustrating an outline configuration of the sheet conveyance path and its periphery including the fixing portion 10 and the secondary transfer portion 70. FIG. 9 is a flowchart illustrating an example of a processing procedure for adjusting tension of the roll sheet S on the downstream side.

In the processing for adjusting tension of the roll sheet S on the downstream side, as shown in FIG. 8, the load of the motor M (described as "fixing motor M" in the following) to drive the fixing roller 12 of the fixing portion 10, specifically, a current value is monitored by a current value detector 97. Further, as shown in FIG. 8, a detection sensor 98 is provided to detect the width W of the roll sheet S and a deviation amount X of the roll sheet S from the center O in the width direction, just on the upstream of the secondary transfer portion 70. A line sensor can be used as the detection sensor 98, for example.

In the following, there will be explained a flow of a series of processing for adjusting the tension of the roll sheet S on the downstream side, following the flowchart of FIG. 9. The series of processing is executed under the control of the control portion 60 (refer to FIG. 3).

After the start of a print job, the control portion 60, before entering print operation, first measures the width W1 of the roll sheet S at a non-conveyance time in a state where tension is not generated, according to a detection output of the detection sensor 98 (step S11), and subsequently performs preliminary conveyance of the roll sheet S for a certain time, for example, for 30 seconds (step S12). Next, the control portion 60 measures the load of the fixing motor M, that is, the current value in the fixing motor M using the detection output of the current value detector 97, and determines whether or not the current value is not larger than a predetermined value, for example, 2.5 A (step S14). Here, the predetermined value of 2.5 A is a current value in consideration of a margin for a rated current of 3.0 A when the rated current of the fixing motor M is 3.0 A, for example.

When it is determined that the current value of the fixing motor M is not larger than 2.5 A (YES in S14), the control portion 60 measures the deviation amount X of the roll sheet S during the preliminary conveyance according to the detection output of the detection sensor 98 (step S15). Here, for the deviation amount X of the roll sheet S, the deviation amount X during a predetermined period (e.g., 5 seconds) is assumed to be measured as a deviation speed. Subsequently, the control portion 60 determines whether or not the deviation speed of the roll sheet S is not higher than a predetermined value, for example, 0.01 mm (step S16).

Then, when the deviation speed of the roll sheet S exceeds 0.01 mm (NO in S16), the control portion 60 determines that the roll sheet S on the downstream side is in a state of too-low tension T3 caused by the condition of a medium, environment (e.g., humidity), or the like, and increases the tension T2 by one step (step S17). Subsequently, the control portion 60 returns to step S15 to measure the deviation speed of the roll sheet S again, and repeats loop processing of step S15 to step S16 to step S17 until the deviation speed of the roll sheet S becomes not higher than 0.01 mm. Then, when it is determined that the deviation speed of the roll sheet S is not higher than 0.01 mm (YES in S16), the control portion 60 enters the print operation (step S18).

When it is determined in step S14 that the current value of the fixing motor M exceeds 2.5 A (NO in S14), the control portion 60 measures the current value of the fixing motor M according to the detection output of the current value detector 97 (step S19). Subsequently, the control portion 60 determines whether or not the current value of the fixing motor M is not larger than the rated current of the fixing motor M, that is, 3.0 A (step S20). Then, when the current value of the fixing motor M exceeds 3.0 A (NO in S20), the control portion 60 determines that the roll sheet S on the downstream side is in a state of too-high tension T3, and reduces the tension T2 by one step (step S21). Subsequently, the control portion 60 returns to step S19 and measures the current value of the fixing motor M again, and, repeats the loop processing of step S19 to step S20 to step S21 until the current value of the fixing motor M becomes not larger than 3.0 A.

Next, when it is determined in step S20 that the current value of the fixing motor M is not larger than 3.0 A (YES in S20), the control portion 60 measures the width W2 of the roll sheet S during the preliminary conveyance in a state where the tension is generated, according to the detection output of the detection sensor 98 (step S22). Then, the control portion 60 determines whether or not a difference W1−W2 between the width W1 of the roll sheet S at the time of non-conveyance in a state where the tension is not generated and the width W2 of the roll sheet S during the preliminary conveyance in a state where the tension is generated is not larger than a predetermined value, for example, 0.5 mm (step S23). Here, W1−W2 indicates a shrinkage amount in the width of roll sheet Sin the image forming portion 40 (described as "roll sheet width shrinkage amount" in the following).

When the roll sheet width shrinkage amount W1−W2 is larger than 0.5 mm (NO in S23), the control portion 60 determines that the roll sheet S on the downstream side is in a state of too-high tension T3, and reduces the tension T2 by one step (step S24). Subsequently, the control portion 60 returns to step S22 and measures the width W2 of the roll sheet S again, and repeats the loop processing of step S22 to step S23 to step S24 until the roll sheet width shrinkage amount W1−W2 becomes not larger than 0.5 mm. The loop processing is performed for the purpose of preventing the roll sheet S from being conveyed in a shrunk state in the width direction and from being transferred, by an excessive tension.

Next, when it is determined in step S23 that the roll sheet width shrinkage amount W1−W2 is not larger than 0.5 mm (YES in S23), the control portion 60 goes to step S18 and enters the print operation. After that, the control portion 60 determines whether the print operation is finished or not (step S25), and, when the print operation is not finished (NO in S25), returns to step S18 and executes the print operation continuously. When the print operation is finished (YES in S25), the control portion 60 returns the tension T2 generated by the friction force with the fixed roller member 93 to the initial state, that is, to the setting at the job start (step S26), and terminates the series of processing for adjusting tension of the roll sheet S on the downstream side.

By the above series of processing, it is possible to set the tension T3 of the roll sheet S on the downstream side to the optimum value by adjusting the tension T2 generated by the friction force with the fixed roller member 93. Thereby, it is possible to sufficiently exhibit a function (refer to Table 1) required for the side regulating members 95A and 95B attached to the downstream side roller member 92. As a result, even when the roll sheet S to be conveyed is a tack sheet, it is possible to obtain a high deviation prevention capability (regulating capability) while suppressing the adhesion of paste to the side regulating members 95A and 95B.

Variation Example

While the present invention has been explained above by the use of the embodiment, the present invention is not limited to the range described in the embodiment. That is, the embodiment can be modified or improved variously without departing from the gist of the present invention, and the modified or improved mode falls also within the technical scope of the present invention.

For example, while the non-print face (image non-formation face) of the roll sheet S slides with the fixed roller member 93 in the embodiment, the present invention is not limited to the configuration. Specifically, it is possible to employ a configuration in which the print face (image formation face) of the roll sheet S slides with the fixed roller member 93 when a scratch mark on the print face of the roll sheet S does not matter for the image formation.

Further, for the roller member 93 to generate the tension T2, it is also possible to employ a configuration in which the roller member is not fixed but rotatable in a circumferential speed lower than the conveyance speed of the roll sheet S (movement speed of the roll sheet S pulled by the fixing roller 12 of the fixing portion 10) and the tension T2 is generated by the break torque.

Further, the image forming apparatus 1 according to the embodiment can be applied to all types of image forming apparatus each using the roll sheet S as a sheet on which an image is formed, such as a printer apparatus, a facsimile apparatus. a printing machine, a multi-functional machine, and the like, in addition to a copy machine.

BRIEF EXPLANATION OF SIGNS

1 . . . image forming apparatus, 2 . . . sheet feeding apparatus, 3 . . . sheet ejecting apparatus, 10 . . . fixing portion, 20 . . . roll sheet main body, 40 . . . image forming portion, 50 . . . intermediate transfer belt, 60 . . . control portion, 70 . . . secondary transfer portion, 80 . . . tension adjusting mechanism, 90 . . . sheet conveying apparatus, 91 . . . upstream side roller member, 92 . . . downstream side roller member, 93 . . . fixed roller member, 94A, 94B . . . first side regulating member, 95A, 95B . . . second side regulating member, 100 . . . image forming system, S . . . roll sheet

What is claimed is:

1. An image forming apparatus, comprising:

a plurality of roller members disposed along a sheet conveyance direction in which a recording sheet is conveyed, the recording sheet being a roll sheet wound in a roll shape;

first side regulating members provided near both end parts of a roller member on an upstream side in the sheet conveyance direction among the plurality of roller members, in a state fixed to edge parts of the conveyed roll sheet, respectively;

second side regulating members provided near both end parts of a roller member on a downstream side in the sheet conveyance direction among the plurality of roller members, in a state rotatable with respect to edge parts of the conveyed roll sheet, respectively; and a tension applying member configured to apply tension to the roll sheet at the roller member on the downstream side by sliding against the roll sheet, the tension applying member being provided between the roller member on the upstream side and the roller member on the downstream side.

2. The image forming apparatus according to claim 1, wherein a tension of the roll sheet generated at the roller member on the upstream side is lower than the tension of the roll sheet generated at the roller member on the downstream side.

3. The image forming apparatus according to claim 1, wherein the tension applying member applies the tension to the roll sheet by sliding against an image non-print face of the roll sheet.

4. The image forming apparatus according to claim 3, wherein the tension applying member comprises a fixed roller member provided in a state not rotatable with respect to the roll sheet.

5. The image forming apparatus according to claim 4, further comprising a tension adjusting mechanism configured to adjust the tension of the roll sheet generated at the roller member on the downstream side by changing a height position of the fixed roller member.

6. The image forming apparatus according to claim 5, wherein the tension adjusting mechanism adjusts the tension depending on a type of the roll sheet.

7. The image forming apparatus according to claim 5, wherein the tension adjusting mechanism adjusts the tension according to a deviation amount of the roll sheet during a predetermined period.

8. The image forming apparatus according to claim 5, wherein the tension adjusting mechanism adjusts the tension according to a width shrinkage amount of the roll sheet at an image forming portion configured to form a toner image on an image carrier.

9. The image forming apparatus according to claim 5, wherein the tension adjusting mechanism adjusts the tension according to a load of a motor configured to convey the roll sheet.

* * * * *